United States Patent [19]

Brunt, Jr.

[11] Patent Number: 4,840,199

[45] Date of Patent: Jun. 20, 1989

[54] REGULATOR SAFETY VALVE

[76] Inventor: Charles D. Brunt, Jr., 322 Country Breeze La., Duson, La. 70529-9562

[21] Appl. No.: 116,250

[22] Filed: Nov. 3, 1987

[51] Int. Cl.[4] ..... A62B 7/00

[52] U.S. Cl. ..... 137/883; 128/202.27; 128/205.24; 251/324

[58] Field of Search ..... 128/202.27, 205.24; 137/883; 251/324

[56] References Cited

U.S. PATENT DOCUMENTS

| | | | |
|---|---|---|---|
| 804,272 | 11/1905 | Schwarz . | |
| 849,121 | 4/1907 | Ge Frorer . | |
| 1,248,957 | 12/1917 | Voigt . | |
| 1,984,828 | 12/1934 | Fornwalt . | |
| 2,266,939 | 12/1941 | Thomas | 128/205.24 |
| 2,766,752 | 10/1956 | Meidenbaur, Jr. . | |
| 2,817,489 | 12/1957 | Hesmer . | |
| 3,219,034 | 11/1965 | Kalenik . | |
| 3,238,943 | 3/1966 | Holley . | |
| 3,302,643 | 2/1967 | Allmand . | |
| 3,341,088 | 9/1967 | Moynihan . | |
| 3,920,033 | 11/1975 | Ferrando . | |
| 3,995,626 | 12/1976 | Pearce, Jr. . | |
| 4,111,342 | 9/1978 | Kirby . | |
| 4,134,573 | 1/1979 | Messinger | 251/324 |
| 4,202,330 | 5/1980 | Jariabka | 128/205.24 X |
| 4,304,229 | 12/1981 | Curtin . | |
| 4,328,798 | 5/1982 | Isaacson . | |
| 4,345,593 | 8/1982 | Sullivan . | |
| 4,392,490 | 7/1983 | Mattingly et al. . | |
| 4,413,622 | 11/1983 | Austin | 128/202.27 X |
| 4,413,662 | 11/1983 | Austin . | |
| 4,433,685 | 2/1984 | Giorgini et al. . | |
| 4,449,524 | 5/1984 | Gray . | |
| 4,570,677 | 2/1986 | Roxton | 137/883 X |
| 4,603,833 | 8/1986 | Christianson | 128/202.27 X |

FOREIGN PATENT DOCUMENTS

| | | | |
|---|---|---|---|
| 106611 | 1/1918 | United Kingdom | 128/205.24 |

*Primary Examiner*—Robert G. Nilson

*Attorney, Agent, or Firm*—Cushman, Darby & Cushman

[57] ABSTRACT

A safety valve for a second stage regulator of a self-contained underwater breathing apparatus including a longitudinally slideable valve stem for selectively interrupting flow between a source of pressurized gas and a second stage regulator. The valve is mounted in line intermediate the first stage regulator and the second stage regulator of the apparatus. The valve has a closed position wherein fluid flow between the first and second stage regulators is cut off and an open position wherein such flow is permitted. Thus, prior to a dive the valve is in its closed position so as to minimize the likelihood of gas leakage from the second stage regulator. When the second stage regulator is to be used, the valve is slid to its open position and pressurized gas is free to flow to the second stage regulator. In the event the second stage regulator malfunctions so as to be maintained in an open or a semi-open position, the valve can again be moved to its closed position to prevent the further leakage of supply air and a backup second stage regulator can be activated by sliding a safety valve associated therewith to an open position and then using the backup second stage regulator.

8 Claims, 2 Drawing Sheets

REGULATOR SAFETY VALVE

BACKGROUND OF THE INVENTION

This invention relates to a safety valve for the second stage regulator of a self-contained underwater breathing apparatus or scuba equipment and, more particularly, to a manually operated safety valve for controlling the air supply to the second stage regulator.

A self-contained underwater breathing apparatus or "scuba" equipment typically includes a pressurized air cylinder with a first stage regulator and dispensing elements with one or more second stage regulators coupled thereto, to provide breathable air to a diver at a controlled rate and pressure. On the water surface as well as while diving, malfunction of second stage regulators has presented a number of problems. More particularly, the second stage regulator is combined with a mouthpiece for dispensing air to the diver and is operated by the pressure differential generated by the diver's breathing. Negative pressure generated during inhalation acts on a diaphragm which actuates a needle valve allowing pressurized air to ventilate the diver's lungs. Positive pressure generated during exhalation on the other hand acts on the diaphragm to close the needle valve and enables venting of the exhaled gasses to the exterior, for example, into the water where it forms the bubbles typically associated with scuba diving.

If foreign matter is introduced into the needle valve of the second stage regulator, the valve may stick in the open or partially open position thus venting valuable supply air through the regulator to the exterior. This prevents proper operation of the device and decreases the life of the air cylinder, possibly jeopardizing the diver. Indeed, this poses a significant hazard during diving as the supply air may be vented to the exhaust before the diver can safely surface. The installation of a back-up second stage regulator on an additional hose in the event the first second stage regulator fails does not overcome this problem because the faulty second stage regulator will continue to vent supply air unless supply air to that regulator can be quickly and easily interrupted by the diver.

Another problem associated with second stage regulators arises when a surface check out of scuba equipment reveals a free-flowing second stage regulator which vents supply air to the atmosphere before the dive. This may cause exhaustion of the air cylinder sufficient to warrant postponement or cancellation of the dive unless additional pressurized cylinders are available at the site.

It would therefore be desirable to provide a means for manually cutting off the supply of air to the second regulator valve prior to a dive as well as during the dive so that undesirable venting of supply air either before or during the dive is prevented.

SUMMARY OF THE INVENTION

The present invention provides a manually operable valve for cutting off the supply of air to a second stage regulator which can be reversibly operated so as to cut off air supply prior to or at any point during a dive.

More particularly, the present invention is a control valve connectable in the air supply line to a second stage regulator of an underwater breathing apparatus. The control valve has at least a first position wherein flow between the first stage regulator and the second stage regulator is obstructed and a second position wherein free-flow between the first stage regulator and the second stage regulator is possible. Further, the valve of the present invention is slidably actuatable by the diver, for example, and can be quickly and easily moved to open or close the air supply line as desired.

Other objects, features and characteristics of the present invention, as well as the methods of operation and functions of the related elements of the structure, and the combination of parts and ecomonies of manufacture, will become more apparent upon consideration of the following detailed description and the appended claims with reference to the accompanying drawings all of which form a part of this specification, wherein like referenced numerals designate corresponding parts in the various figures.

DETAILED DESCRIPTION OF THE PRESENTLY PREFERRED EXAMPLARY EMBODIMENT

Figure 1:
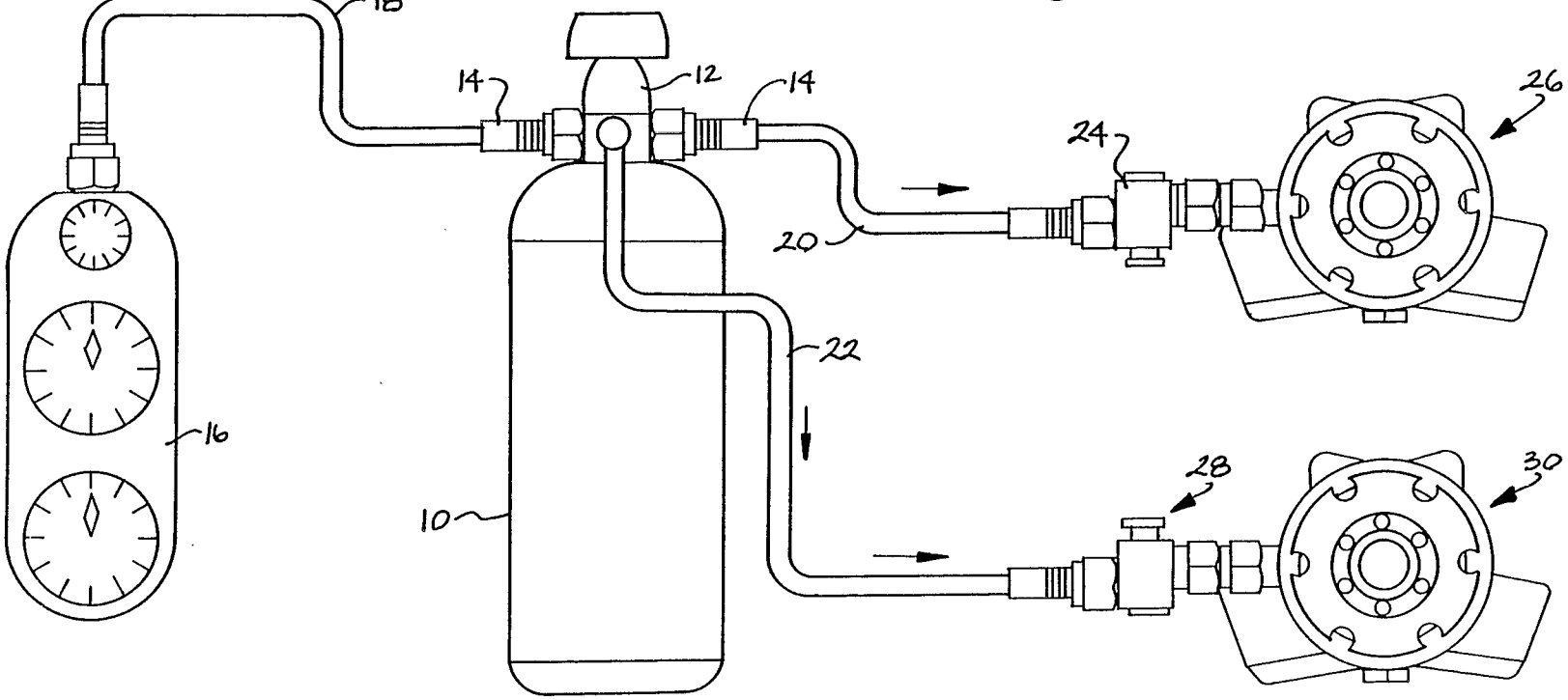
FIG. 1 is a schematic illustration of a self-contained underwater breathing apparatus including safety regulator valves formed in accordance with with present invention.

Referring to FIG. 1, scuba equipment typically includes an air cylinder 10 for supplying air to a diver during a dive and a first stage regulator 12 mounted to the top of the air cylinder which has a number of nozzles 14. One of the nozzles is typically connected to a submersible high pressure gauge 16 via a high pressure line 18 so that the air pressure within air cylinder 10 can be monitored. There are preferably two air supply lines 20, 22 proceeding from regulator 12 at the 140 psi side of the first stage regulator. In the illustrated embodiment, one line 20 is connected to a regulator safety valve 24 of the present invention, which is in turn connected to a second stage regulator 26. The other line 22 is connected to another regulator safety valve 28 formed in accordance with this invention, which is in turn connected to a backup second stage regulator 30. The purpose of the backup second stage regulator 30 is for use in the event of a malfunction of the primary second stage regulator 26 or for use by another diver if the necessity for sharing the air supply arises. The function of the two regulator safety valves 24, 28 is identical and will be described more fully below. Further, the safety valves are preferably mounted immediately adjacent the second stage regulators for quick access and easy operation by the diver.

Figure 2:
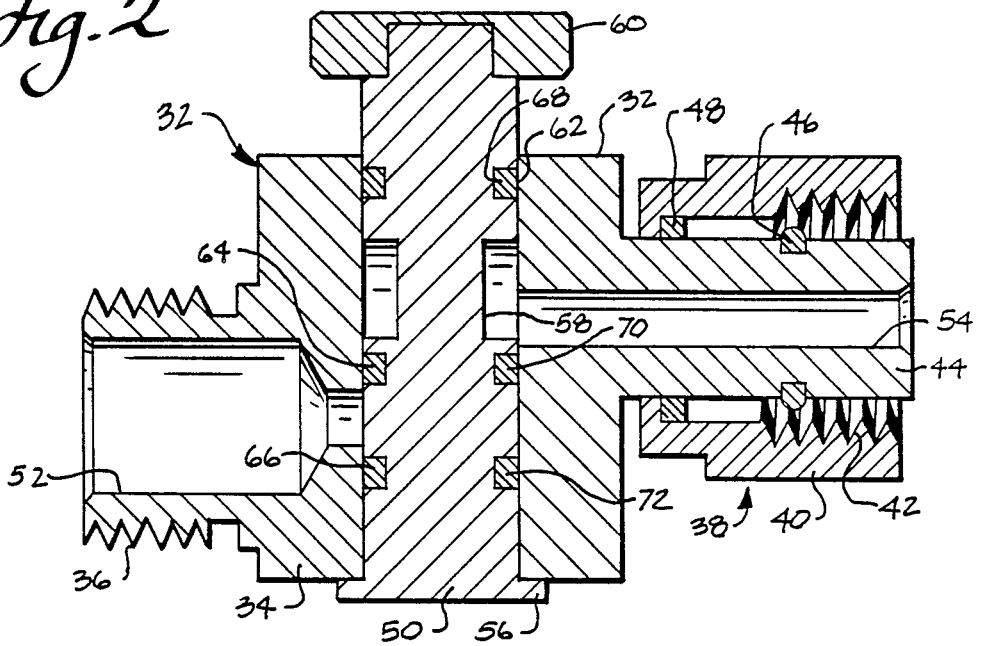
FIG. 2 is a cross sectional view showing a valve formed in accordance with the present invention in a closed position so as to obstruct flow between the first and second stage regulators.

Referring to FIG. 2, safety valve 24 is shown in its closed position. The valve housing 32 includes a first coupler 34 for mounting in line to hose 20 from first stage regulator 12. In the illustrated embodiment the coupling has exterior threads 36 adapted to be coupled to a lock nut connector, for example, of the type provided for coupling valve 24 to second stage regulator 26, described hereinafter. It is to be understood, however, that other couplings could be provided to connect the valve in line without departing from this invention.

A second coupler 38 is mounted to valve housing 32 for connecting the valve to second stage regulator 26. In the illustrated embodiment the coupling has a lock nut 40 with screw threads 42 on the interior thereof for mounting to an exteriorally threaded coupling structure (not shown), for example, of the type shown for coupler 34. As lock nut 40 is threadingly attached to the second stage regulator, male portion 44 of coupler 38 will extend into the interior of the regulator coupler. An O-ring 46 or other suitable fluid-tight sealing means is preferably mounted to male portion 44 of coupler 38 and, thus, provides a fluid tight seal intermediate male portion 44 and the interior wall of the second stage regulator coupler. A second O-ring 48 or similar fluid tight elastomeric sealing material is furher provided at the closed end of lock nut 40 so as to engage the periphery of the open end of the regulator coupler to ensure that no air will escape from the coupling and, likewise, no fluid will flow thereinto. Coupler 34 is coupled to hose 20 in a similar manner.

Referring to the valve structure in particular, a cylindrical axially slidable valve stem 50 is mounted within valve housing 32 and provides selective fluid communication between the bore 52 of the first connector 34 which is coupled to the supply air and the bore 54 of the second connector 38 which is coupled to the second stage regulator, as described above. A flange 56 is formed at the first end of valve stem 50 for limiting axial movement of the valve stem in one direction. A cap 60 is fixedly secured to the second end of the valve stem after assembly so that movement of the valve in the other direction (downwardly in FIG. 2) will be limited, as discussed more fully below.

A circumferential passage 58 is defined in the surface of valve stem 50 to enable fluid flow as desired. More particularly, in the closed position, illusrated in FIG. 2, the cylindrical passage 58 is confined within housing 32 so as to solely communicate with the bore 54 of connector 38 and thus no fluid flow is possible. Sealing members, for example, O-rings 60, 62, 64 are intermediately mounted to the valve stem 50 and housing 32. In the illustrated embodiment, the O-rings 62, 64, 66 are mounted in suitable cut out portions or grooves 68, 70, 72 defined in the stem. However, it is to be understood that such grooves and O-rings could be provided on the interior wall surface of housing 32 rather than on valve stem 50. As will become apparent to one of ordinary skill, though, construction is simpler and easier if these O-rings are mounted to the valve stem itself.

As can be seen, O-rings 62 and 64 are mounted so as to be disposed on either side of cylindrical passage 60 so that fluid flow into or out of this passage is limited to direct communication between passage 60 and the inlet bore 52 and/or the outlet bore 54. The third O-ring 66 is provided so as to seal off inlet bore 52 when the valve stem is in its closed position, as shown in FIG. 2.

Figure 3:
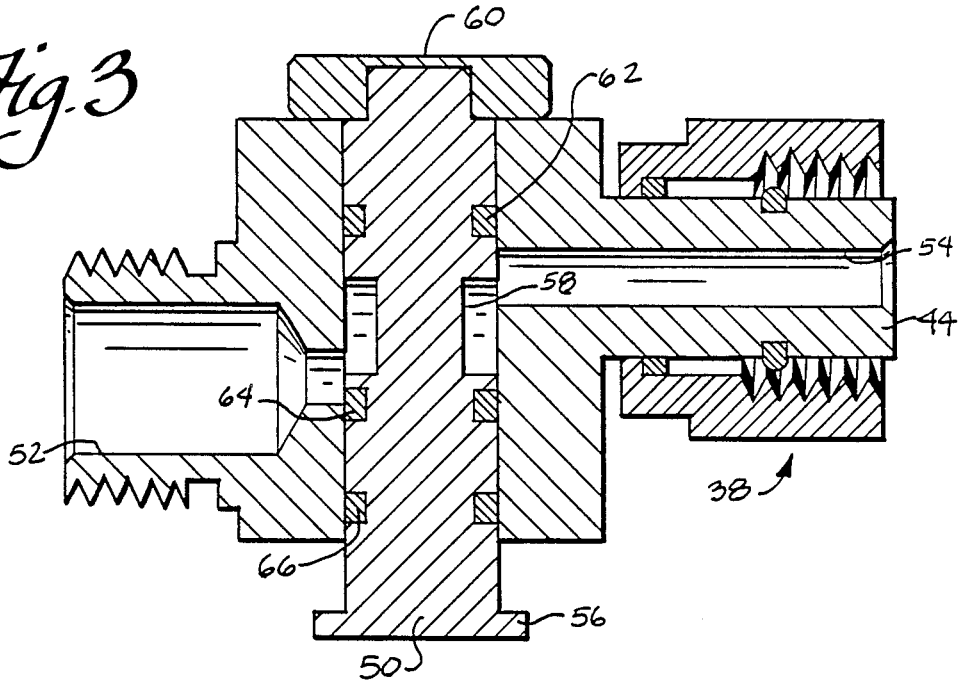
FIG. 3 is a cross sectional view showing the valve in an open position so as to permit the flow of air from the first to the second stage regulator.

When valve 24 is to be opened so as to allow flow between the first and second stage regulators, valve stem 50 is pushed downwardly as illustrated in FIGS. 1 and 2, along its longitudinal axis so that cylindrical passage 60 is moved into communication with both the inlet bore 52 and the outlet bore 54, as shown in FIG. 3. As can be seen, the first and second O-rings 62,64 are spaced apart on either side of cylindrical passage 60 so as to seal the region defined by the inlet bore 52, the cylindrical passage 60 and the outlet bore 54. The lower peripheral surface of cap 58 limits the downward movement of the valve stem so that proper communication between the three passages is ensured. Likewise, when the valve is "closed", valve stem 50 is pushed upwardly from the position shown in FIG. 3 to the position shown in FIG. 2. Flange 56 limits this upward movement to ensure O-rings 62, 64 seal off the inlet bore 52 from cylindrical passage 60 and hence, the outlet bore 54 from the inlet bore 52.

While in the illustrated embodiment the valve stem is cylindrical and the flow passage defined thereabout is circumferential it is to be understood that a valve element of another shape, for example rectangular, could be provided. Likewise, where the valve stem is mounted so that rotational movement relative to the housing is not possible or is limited, the throughpassage 60 can be a bore through the stem rather than a circumferential passage as shown.

Furthermore, the particular materials that would be most desirable for the valve of the present invention, will be readily apparatus to the ordinary artisan upon a review of this disclosure but it is contemplated that a corrosion resistant metal such as stainless steel and/or a rigid plastic alone or in comination with resilient rubber casings would be most suited to the intended use of the valve.

While the invention has been described in connection with what is presently considered to be the most practical and preferred embodiment, it is to be understood that the invention is not limited to the disclosed embodiment, but, on the contrary, it is intended to cover various modifications and equivalent arrangements included within the spirit and scope of the appended claims.

What is claimed is:

1. A self-contained underwater scuba apparatus comprising:

an air cylinder for receiving and containing pressurized air;

a first stage regulator mounted to an outlet of said air cylinder and defining a plurality of nozzles;

a first second stage regulator;

a second second stage regulator;

a first control valve mounted intermediate said first stage regulator and said first second stage regulator, said first control valve including a valve housing having a first connector comprising an externally threaded female connector element connectable to a source of breathable gas and a second connector comprising a male connector element having a lock nut element mounted circumferentially thereabout and connected to the first second stage regulator of the underwater breathing apparatus, an intermediate valve stem receiving passage; and an intermediate valve stem mounted within said stem receiving passage so as to be slidable along a longitudinal axis thereof; said valve stem including means defining a flowthrough passage between a bore of said first connector and a bore of said second connector such that the valve stem is slidable from a first position wherein communication between said first and second connector bores is cut off to a second position wherein flow therebetween is possible via said flowthrough passage; and a second control valve mounted intermediate said first stage regulator and said second second stage regulator.

2. An apparatus according to claim 1, wherein said valve stem is cylindrical and said flowthrough passage is a circumferential groove defined about at least a portion of the periphery of said cylindrical valve stem.

3. An apparatus according to claim 1, further comprising means mounted to at least one of the outer surfaces of said valve stem and the inner surface of said valve housing for providing a fluidtight seal between said valve stem and said valve housing.

4. An apparatus according to claim 3, wherein said means for providing a fluid-tight seal comprise a plurality of O-rings.

5. An apparatus according to claim 3, wherein said means for providing a fluid-tight seal includes at least one circumferential groove defined in the outer surface of said valve stem and an O-ring element disposed in each such circumferential groove.

6. An apparatus according to claim 5, wherein there are three grooves defined at spaced locations along the outer surface of said valve stem and an O-ring mounted in each of said grooves.

7. An apparatus according to claim 5, wheren an O-ring is mounted in a groove defined on either side of the portion of said valve stem defining said flowthrough passage and a third O-ring is mounted in a groove space from said first and second O-rings so that when said valve stem is in said first position, said first, second and third O-rings are defined respectively intermediate said second connector bore and one longitudinal end of said valve stem receiving chamber, intermediate said flowthrough passage and said first connector bore and intermediate said first connector bore and the other longitudinal end of said valve stem receiving bore.

8. An apparatus according to claim 1, further comprising an O-ring element circumferentially mounted in a groove defined in an outer surface of said male connector element.

* * * * *